United States Patent [19]

Hatanaka et al.

[11] Patent Number: 4,969,915

[45] Date of Patent: Nov. 13, 1990

[54] CONTAINER AND METHOD FOR GERM-FREE PACKAGING

[75] Inventors: Koichi Hatanaka, Sayama; Takeo Ide, Kawagoe, both of Japan

[73] Assignee: Snow Brand Milk Products Co., Ltd., Hokkaido, Japan

[21] Appl. No.: 381,943

[22] Filed: Jul. 19, 1989

[30] Foreign Application Priority Data

Jul. 26, 1988 [JP] Japan ..... 63-186450

[51] Int. Cl.[5] ..... B65B 31/00

[52] U.S. Cl. ..... 53/425; 53/296; 53/426; 53/435

[58] Field of Search ..... 53/425, 426, 403, 431, 53/435, 531, 111 R, 296

[56] References Cited

U.S. PATENT DOCUMENTS 3,783,581 1/1974 Pierce ..... 53/426

4,417,607 11/1983 Scholle et al. ..... 53/426 X

FOREIGN PATENT DOCUMENTS 8701293 1/1989 Netherlands ..... 53/425

*Primary Examiner*—James F. Coan

*Attorney, Agent, or Firm*—Griffin Branigan & Butler

[57] ABSTRACT

An outer container is detachable mounted on a neck of an inner container having its interior previously sterilized and sealed with a portion of the inner container underlying the neck being sealed. Such container assembly of double structure is sterilized and dried, then transferred into a germ-free filling chamber isolated from the atmosphere here the top of the inner container is cut off, then the inner container is filled with food or drink and the cut off portion is sealed again. Finally the outer container is separated from the inner container outside the germ-free filling chamber.

9 Claims, 9 Drawing Sheets

CONTAINER AND METHOD FOR GERM-FREE PACKAGING

BACKGROUND OF THE INVENTION

The present invention relates to a packaging container adapted to be kept germ-free after having been filled with sterilized food and drink and also to a method for filling said packaging container with sterilized food and drink in a germ-free manner.

Recently, germ-free filling of food and drink has rapidly come into wide use to meet a market demand for long period preservation of food or drink without deterioration of its quality.

Particularly for drink, such germ-free filling technique has been adopted in practice for many years and presentation for a period in order of three months and an effort and an attempt have been made to develop an improved technique which will be effective generally for processed foodstuffs.

One of such method for germ-free packaging of foodstuffs is disclosed by Japanese Patent Publication No. 1980-3218, which utilizes a molded container to perform filling of food stuffs under a germ-free condition and more specifically, comprises steps of molding the container so as to establish first of all said germ-free condition inside the container, sterilizing also the exterior of said molded container, transferring said molded container into a germ-free chamber in which a top of said molded container is then opened, filling said molded container with food or drink through the opened top and then sealing said molded container.

According to this prior art, the respective steps such as those of container top opening and food or drink filling may be carried out in the germ-free atmosphere to provide products suitable for long term preservation.

However, such germ-free filling and packaging system of prior art has been found to be disadvantageous in that the respective steps such as those of sterilizing, opening and sealing the container are designed for a particular molded container and, in consequence, the system could not accommodate any variation in design factors, for example, a configuration of the molded container being handled only within a limited range.

In other words, the respective steps are usually required by the germ-free filling and packaging system, for example, the steps of container transferring, container opening, content filling and sealing container are designed for a particular configuration of the container to be handled by this system and, therefore, it has inconveniently been necessary for such germ-free filling and packaging system that said system must be substantially redesigned each time it is desired, using the same system to handle a group of containers of a different configuration. In addition, such germ-free filling and packaging system should be provided in the respective steps with additional technical means in order that this system is previously designed so as to accommodate containers of various types.

Accordingly, in order to accommodate molded containers of various types, the germ-free filling and packaging system of prior art would be bulky and of a correspondingly increased cost. It is impossible to make the system compact and thereby to reduce its installation space thereof.

Furthermore, shutdown of type system is required each time the type of the container, for example, the configuration thereof is changed, so that the continuous operation is precluded and, in a consequence, it becomes difficult for the desired germ-free condition to be maintained.

In view of a fact that a market demand has increased for wider variety of goods, a demand for an improved germ-free filling and packaging technique adapted to accommodate the containers of various types with ease has correspondingly increased.

SUMMARY OF THE INVENTION

An object of the present invention is to provide container adapted to be effectively filled with food or drink in a germ-free manner without any mechanical modification of a corresponding germ-free filling and packaging system even when the container is changed over from one configuration to any other configuration.

This object is achieved, in accordance with the present invention, by a germ-free packaging container comprising an inner container having its interior previously sterilized and sealed, and an outer container detachably mounted on a neck of said inner container, wherein said outer container is able to seal a portion of said inner container underlying said neck thereof.

Another object of the present invention is to provide a method utilizing said germ-free packaging container to achieve germ-free filling of food or drink.

This object is achieved, according to the present invention, by a germ-free filling method comprising steps of detachably mounting an inner container having its interior previously sterilized within a dividable outer container with a top of said inner container projecting out from said outer container, placing such container assembly of double structure successively into sterilizing and drying chambers both sealed from the atmosphere to sterilize and dry, respectively, the exterior of said container assembly, then transferring said container assembly into a germ-free filling chamber also sealed from the atmosphere, in which the top of the inner container projecting out from said outer container is cut off from said container assembly, said inner container is filled with food or drink and then sealed again, discharging this container assembly out from the germ-free filling chamber, and finally separating the outer container from the inner container to obtain the inner container filled with germ-free food or drink.

According to the present invention, the inner container may have selectively any configuration within a dimensional limitation of the outer container to be assembled with said inner container, resulting in an increased variation of the germ-free filled container, and the germ-free filling and packaging system is designed for a particularly dimensioned and configured outer container so that neither modification of the system nor additional cost is required even when the inner container is changed in its configuration.

Furthermore, the inner container is air-tightly surrounded by the outer container so that any outer pressure possibly exerted on the container assembly may be effectively resisted only by the outer container during steps such as those of opening, filling and sealing performed within the germ-free filling and packaging system and, in a consequence, a wall thickness of the inner container may be reduced with a result of correspondingly reduced cost.

Additionally, a further reduction of cost is achieved since the outer container is reusable after the inner container has been removed the associated outer container.

BRIEF DESCRIPTION OF THE DRAWINGS

The above and other objects of the invention will be seen by reference to the description taken in connection with the accompanying drawings, in which.

DETAILED DESCRIPTION OF THE INVENTION

Figure 1:
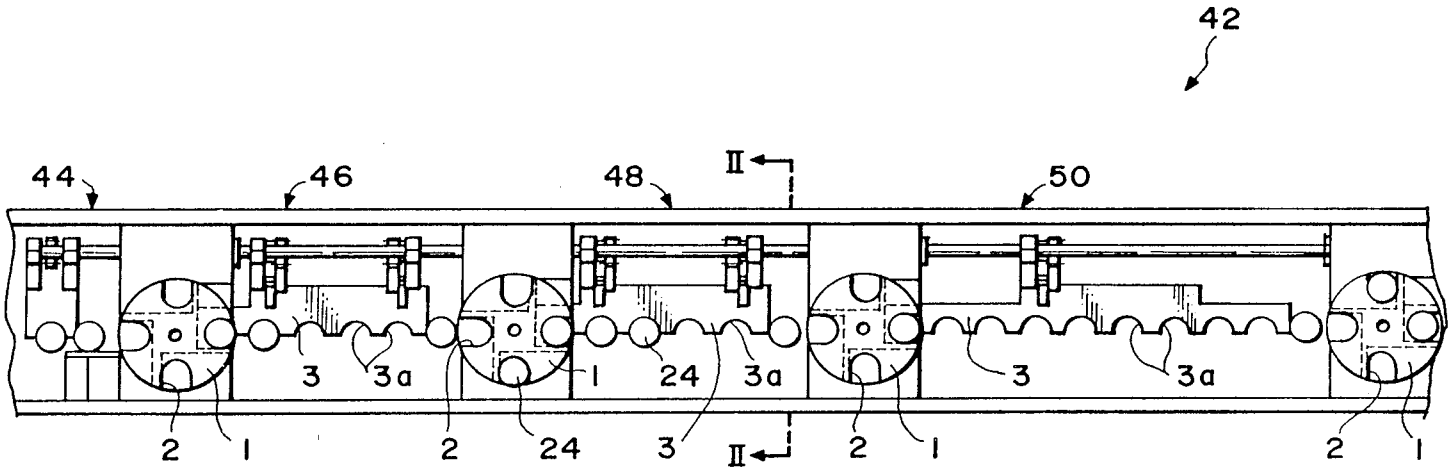
FIG. 1 is a plan view showing an embodiment of the germ-free filling and packaging system 40 utilizing the germ-free filling method of the present invention.

One embodiment of the germ-free filling method of the present invention will be described in reference with FIG. 1.

A germ-free filling packaging system 42 used for the germ-free filling method of the invention comprises a container supply station 44, a germicide mist fixing station 46 serving as a sterilizing chamber, a germicide removing station 48 serving also as a drying chamber, a filling/sealing station 50 where filling of food or drink occurs, and rotatable container receptacles 1 respectively provided beetween the container supply station 44 and the germicide mist fixing station 46, between the latter 46 and the germicide removing station 48, between the latter 48 and the filling/sealing station 50, and at an outlet of the latter 50.

Each of said rotatable container receptacles 1 includes four conveying recess 2 formed therein at angular intervals of 90 degrees so that each section may be successively sealed by intermittently rotating the container receptacle 1 by ¼ revolution. There is provided between each pair of the adjacent container receptacles 1, a comb-toothed conveying arm 3 for so-called box-motion and a guide rail 20 operatively associated with said conveying arm 3 so that the germ-free packaging container 24 is held between a combtooth 3*a* of said conveying arm 3 and said guide rail 20 and thus conveyed.

Figure 3:
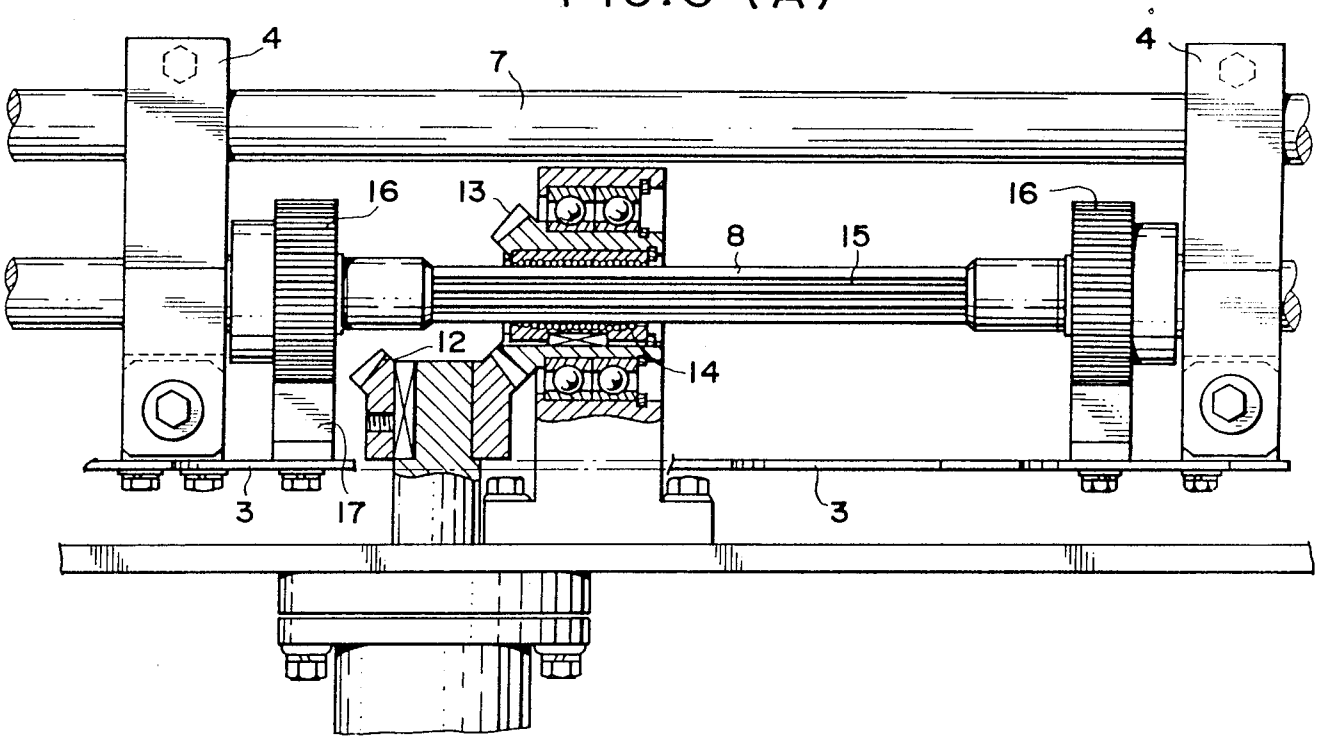
Figure 3:
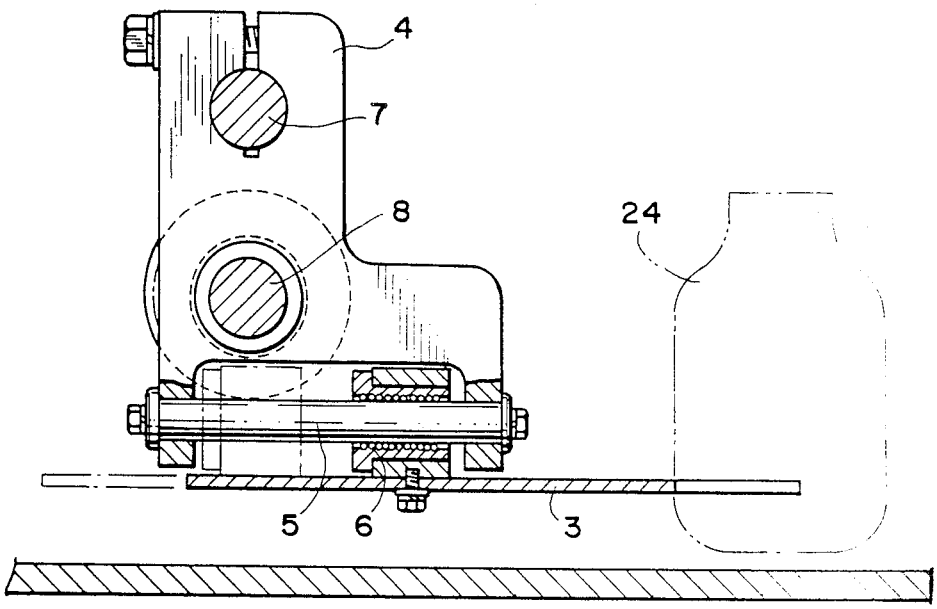

Now said box-motion of the conveying arm 3 will be discussed in reference with FIG. 4 and first of all, the mechanism for driving the conveying arm 3 back and forth will be considered. As seen in FIG. 3B, the conveying arm 3 is supported by a ball bearing 6 back and forth slidably with respect to a shaft 5 of the bearing brackets 4. Referring to FIG. 3A, a drive force provided from a drive mechanism not shown is transmitted through bevel gears 12 and 13 to a ball bearing 14 carried by said bevel gear 13, which ball bearing 14, in turn, rotates a shaft 8 by engagement with splines 15 formed around said shaft 8. Rotation of this shaft 8 causes a pinion 16 mounted on said shaft 8 to be rotated and thereby a rack 17 mounted on the conveying arm 3 adapted to be engaged with said pinion 16 drives the conveying arm 3 back and forth.

It should be understood that the shaft 8 is movable also laterally as the bearing brackets 4 are laterally moved, because of the above mentioned arrangement such that the bevel gear 13 is provided with the ball bearing 14 and the shaft 8 is provided with the splines 15.

Figure 5:
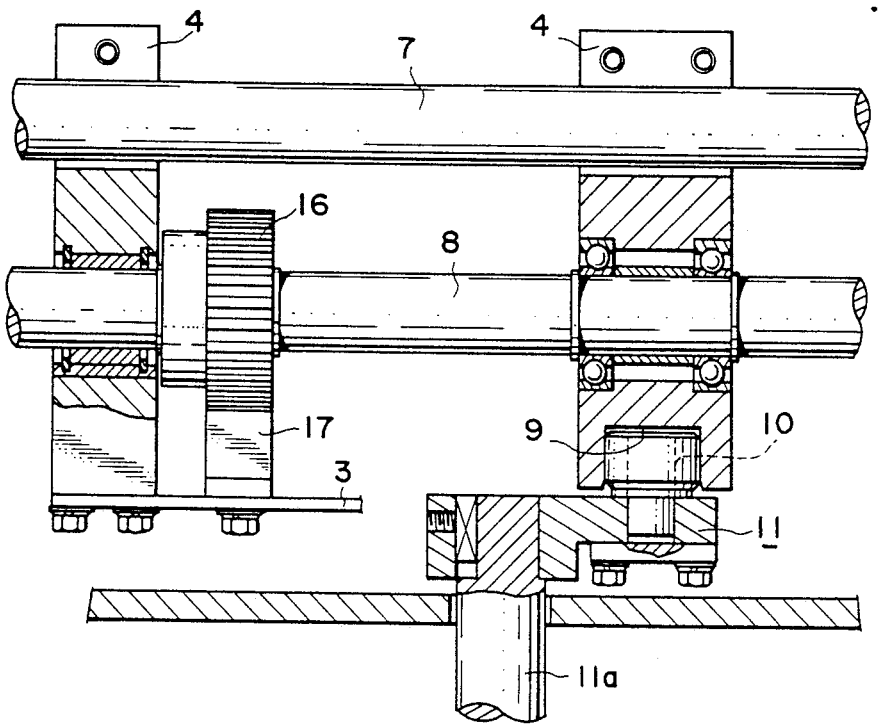
FIGS. 5A and 5B are respectively front and right side views showing, partially in section, a mechanism adapted for laterally driving the bearing brackets 4 and the conveying arm 3.
Figure 5B:
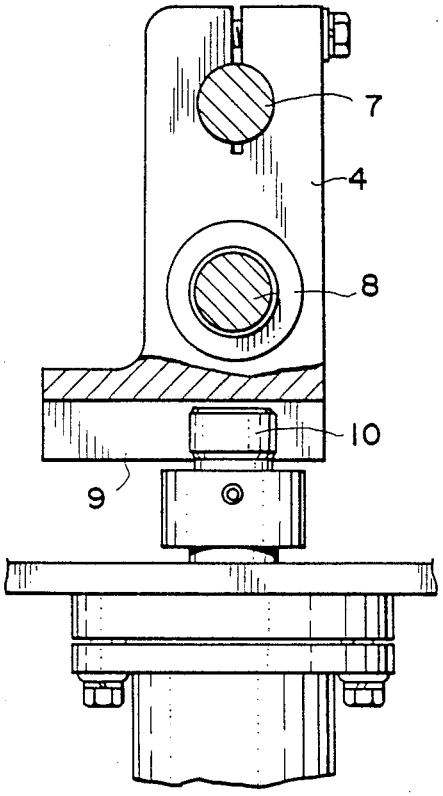

Then, the mechanism to drive the conveying arm 3 laterally will be considered in reference with FIGS. 5A and 5B.

The bearing brackets 4 are laterally movable along a rail 7 and the rotatable shaft 8 extends through said bearing brackets 4. It should be noted here that the rotatable shaft 8 is provided with suitable stopper means allowing said shaft 8 to be laterally moved integrally with said bearing brackets 4.

The bearing brackets 4 are respectively provided in bottoms thereof with grooves 9 in which the associated rollers 10 are movably received. Each of said rollers 10 is mounted on a rotatable arm 11 at an end remote from a shaft 11*a* associated with the rotatable arm 11. Rotation of this shaft 11 causes the roller 10 to move along said groove 9, thereby causes the bearing brackets 4 to be laterally moved and thereby causes the conveying arm 3 also to be laterally moved.

Figure 4:
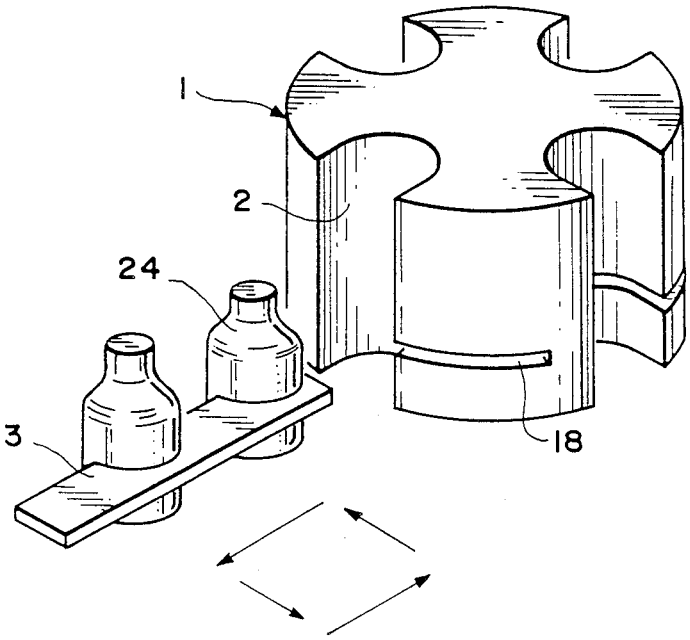
FIG. 4 is a perspective view illustrating a relationship of the conveying arm 3 with a rotatable container receptacle 1.

Such back and forth movement and lateral movement of the conveying arm 3 may be combined to provide a box-motion of the conveying arm 3 as indicated by arrows in FIG. 4.

More specifically, the conveying arm 3 moves forth in into engagement with the container to convey it, and moved back after a conveyance over a predetermined distance to its home position. Such motion is repeated.

As shown by FIG. 4, a recess 2 for conveyance of the container is provided in its side wall with a horizontal slit 18 so that the conveying arm 3 may partially enter into the recess 2 along said slit 18 to deliver the container into this recess 2 and simultaneously to seal upper and lower portions of this recess 2 from the atmosphere, preventing an air leakage.

Figure 2:
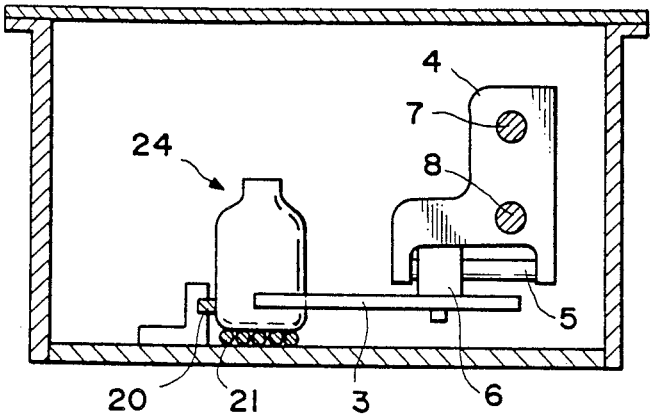
FIG. 2 is a sectional view taken along a line II—II in FIG. 1, FIGS. 3A and 3B are respectively front and left side views showing, partially in a section, a mechanism adapted to drive the bearing brackets 4 and conveying arm 3 back and forth.

Referring to FIG. 2, reference numeral 20 designates a guide for a rear side of the container and reference numeral 21 designates a frame surface along which the container is slidably moved.

Next, the germ-free packaging container of the present invention will be described in details.

Figure 6:
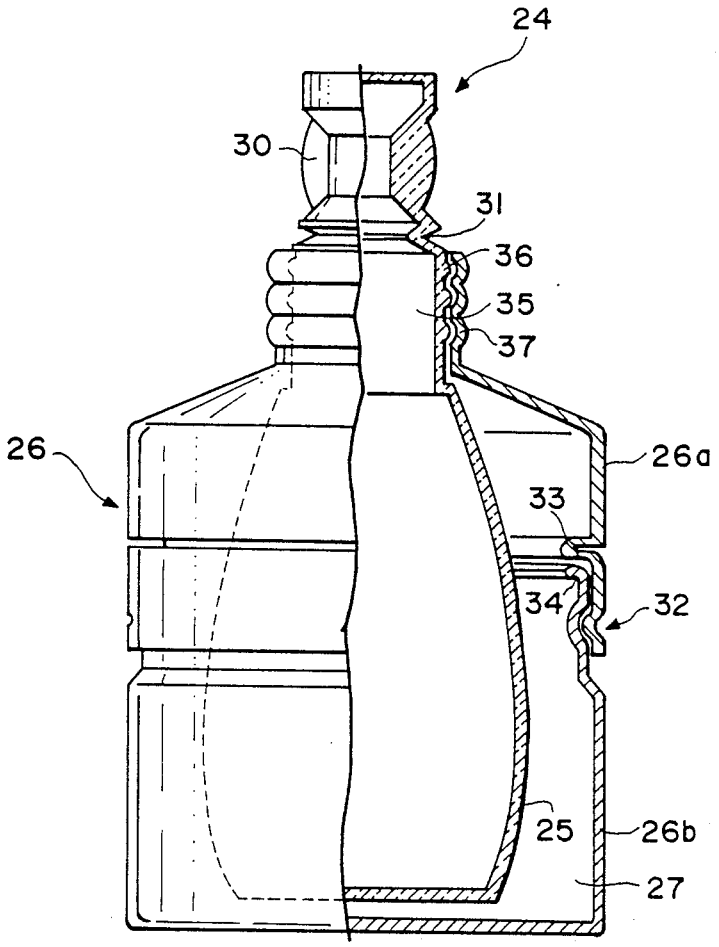
FIG. 6 is a front view showing, partially in section, an embodiment of the germ-free packaging container according to the present invention.

The germ-free packaging container 24 shown by FIG. 6 is a container of double structure, i.e., a container assembly comprising an inner container 25 and an outer container 26 enclosing said inner container 25. The inner container 25 is molded by means of suitable technique such as injection molding with its interior previously sterilized and sealed.

A top 30 of the inner container 25 is easily cut off from the rest along a notch 31 and thereby the interior of the inner container 25 is unsealed.

The outer container 26 consists of an upper portion 26*a* and a lower portion 26*b* which are connected to each other through resilient engagement at 32. Reference numeral 33 designates a stopper adapted to bear against the upper edge 34 of said lower portion 26*b*.

The inner container 25 is provided around its neck 35 with a male thread 36 adapted to be engaged with a female thread 37 formed on the upper portion 26a of the outer container 26 in a suspended condition.

In this manner, a sealed condition is assured by engagement between these male and female threads 36, 37 and the above mentioned connection through the resilient engagement at 32.

Although the embodiment of the germ-free packaging container has been described with respect to the specific construction in which the outer container is dividable into the upper and lower portions, the other various constructions also are employed within a scope of the present invention so far as the inner container is separable from the outer container. For example, the outer container may be designed to be dividable along a vertical plane.

Now, the germ-free filling method utilizing the germ-free packaging container 24 constructed according to the present invention as has been described above will be explained on the assumption that the previously mentioned germ-free filling and packaging system 42 is employed, in reference with FIGS. 7A through 7F.

Figures 7A, 7B, 7C, 7D, 7E, 7F:
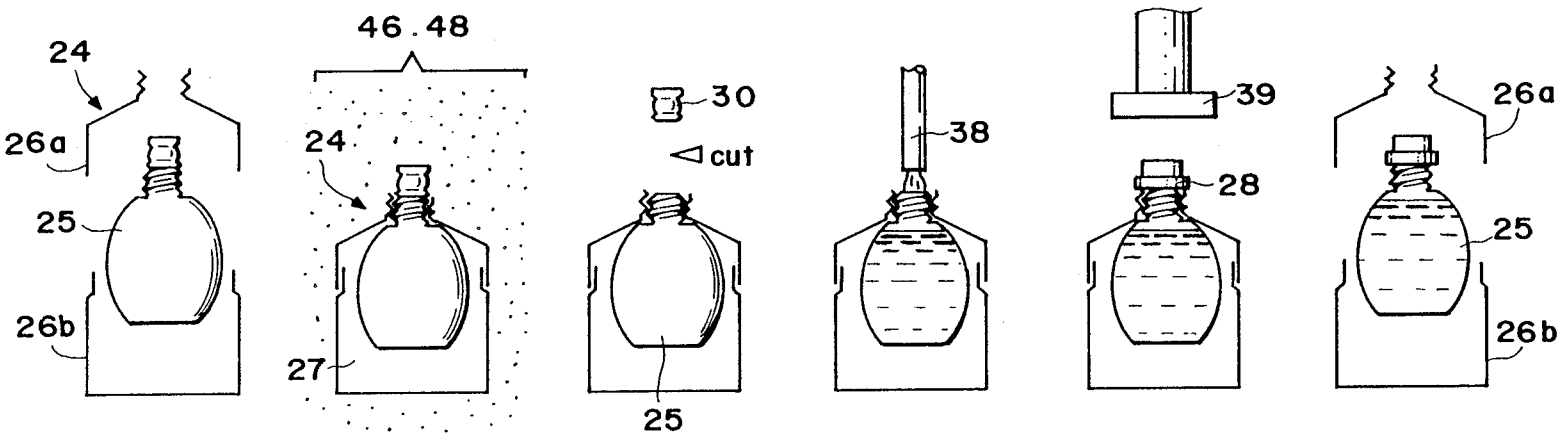
FIGS. 7A through 7F are diagrams illustrating an embodiment of the germ-free filling method according to the present invention.

Referring to FIG. 7A, the outer container 26 is mounted on the inner container 25 having its interior previously sterilized and sealed to provide the germ-free packaging container 24 in the form of a container assembly before supplied to the germ-free filling and packaging system 42.

This germ-free packaging container 24 is, as shown by FIG. 7B, supplied into the germ-free filling and packaging system 42 through the container supply station 44. The exterior of the germ-free packaging container 24 is sterilized and dried in the germicide mist fixing and germicide removing stations 46, 48, respectively.

Although said germicide is prevented from entering into both the interior of the inner container 25 and a gap 27 air-tightly defined inside the outer container 26, the germ-free condition is assured because the inner container 25 has its interior previously sterilized, as has previously been mentioned.

Then, the germ-free packaging container 24 is conveyed into the filling/sealing station 50 (see FIG. 1), the top 30 of the inner container 25 is cut off, as shown by FIG. 7C, and thereby the inner container 25 is unsealed. Next, filling of germ-free food or drink into the inner container 25 occurs through a filling nozzle 38, as shown by FIG. 7D. Thereafter a cap seal 28 made of previously sterilized sealing material is formed on the top of the inner container 25 by operation of sealing means 39 and thereby the inner container 25 is sealed again.

The filling/sealing station 50 (see FIG. 1) provides germ-free atmosphere and, therefore, various germs are effectively prevented from entering into the inner container 25 during these steps.

It should be understood that the cap seal 28 may be replaced by a simple stopper of plug type.

The germ-free packaging container 24 thus filled and sealed is then discharged from the filling/sealing station 50 (see FIG. 1) and the outer container 26 is divided into the upper portion 26a and the lower portion 26b in order to take the inner container 25 thereout, as seen in FIG. 7F. The inner container 25 thus germ-free filled with food or drink is brought as a final product to market. It should be reminded, as has already been mentioned, that the inner container 25 selectively may have any configuration within the dimensional limitation of the outer container 26 and no design modification is required for various means such as conveying means, opening means and filling means in the germ-free filling and packaging system so far as the configuration of the outer container 26 is not changed. Although the outer container 26 may be of same material as the inner container 25, the outer container 26 is preferably made of hard and rigid material such as metal from the viewpoint of its reuse and reliable assembly and disassembly accompanied with no damage. Moreover, by molding the outer container from the material able to provide an adequate strength when the assembly is made to enclose the inner container, the wall thickness of the latter may be correspondingly reduced.

Connection of the upper portion 26a to the lower portion 26b of the outer container 26 is not limited to the previously mentioned means utilizing the resilient engagement, but it is also possible to form respective portions 26a, 26b with corresponding screw threads adapted to be engaged with each other.

Figure 8:
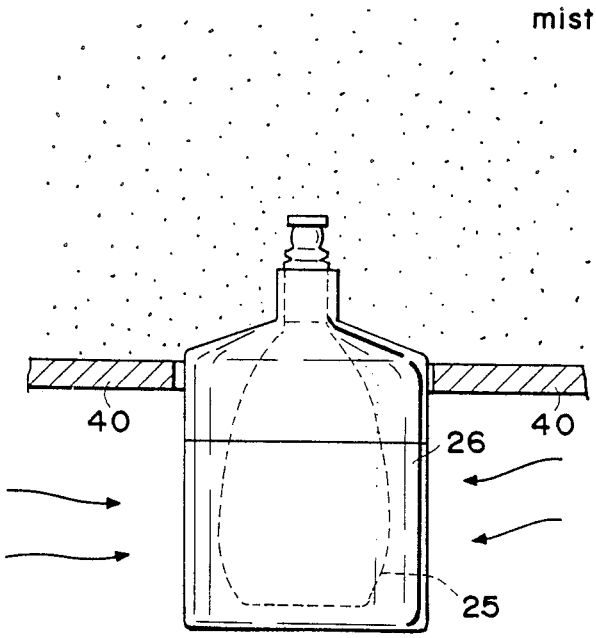
FIG. 8 is a front view illustrating by way of example a method to sterilize the germ-free packaging container of the present invention.

FIG. 8 illustrates a variant of the sterilizing steps. Specifically, the germ-free packaging container is sterilized at its portion including the top of the inner container projecting out from the outer container and exposed above an isolating wall 40 by germicide spray and at its portion extending below said isolating wall 40 by heating, for example, utilizing hot air. By carefully and sufficiently sterilizing the top 30 of the inner container 25 which would otherwise be readily contaminated with germs, the desired germ-free filling is achieved.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A method of germ-free filling a product into a container therefor, comprising:

(a) detachably mounting a sealed inner container with a previously sterilized interior within a dividable outer container such that a top portion of the inner container projects upwardly from said outer container, whereby an assembly of said containers is provided;

(b) moving the assembly successively into and through a sterilizing chamber and a drying chamber, both of which said chambers are sealed from the atmosphere, and sterilizing and drying the assembly;

(c) moving the sterilized and dried assembly into a germ-free filling chamber which is sealed from the atmosphere;

(d) removing at least a part of the said top portion of the inner container so as to expose the interior of the inner container for filling of the product thereinto;

(e) filling into the interior of the inner container the said product;

(f) sealing the inner container near at least the said top portion from which said part was removed such that the filled product in the inner container is sealed therein;

(g) moving the sealed assembly from the filling chamber; and (h) separating the outer container from the sealed inner container and recovering the sealed inner container.

2. The method of claim 1 wherein the inner container is mounted in the outer container such that an outer container upper portion is resiliently engaged by an outer container lower portion.

3. The method of claim 1 wherein said part of the top portion of the inner container is removed by cutting said part away from the said top portion.

4. The method of claim 1 wherein a sealing cap is sealed onto said top portion so as to seal the inner container.

5. The method of claim 1 wherein a germicide is misted into the sterilizing chamber so as to sterilize the exterior of the said assembly.

6. A germ-free filling method as recited in claim 1 wherein the outer container is dividable into upper and lower portions.

7. A germ-free filling method as recited in claim 1 wherein the outer container is dividable along a vertical plane.

8. A germ-free filling method as recited in claim 1 wherein the sterilizing chamber is provided with a horizontal isolating wall through which the assembly protrudes, such that at least the top portion of the inner container lies upwardly of the wall and is sterilizable in a manner different from the manner in which the portion of the assembly lying downwardly of the wall is sterilizable.

9. The method of claim 6 wherein the outer container is divided along a horizontal line.

* * * * *